United States Patent [19]

Stephenson

[11] 4,367,835

[45] Jan. 11, 1983

[54] FEEDER FOR NAILING MACHINE

[76] Inventor: Ronald G. Stephenson, R.D. #1 Box 268, Hamburg, N.J. 07419

[21] Appl. No.: 164,045

[22] Filed: Jun. 30, 1980

[51] Int. Cl.[3] ..... B27F 7/13

[52] U.S. Cl. ..... 227/109; 227/3; 227/155

[58] Field of Search ..... 227/3, 109, 155

[56] References Cited

U.S. PATENT DOCUMENTS

| | | | |
|---|---|---|---|
| 3,273,776 | 9/1966 | Bryson | 227/109 |
| 3,898,725 | 8/1975 | Carter | 227/3 |
| 3,942,699 | 3/1976 | Stanton | 227/3 |

*Primary Examiner*—Paul A. Bell

[57] ABSTRACT

This invention provides improvements in nail feeding control as presented in U.S. Pat. No. 3,273,776. The ratchet system of the reference patent has been improved upon by use of a two-position drum bar which is moved by a cylinder. The latter is activated by a programmer to select nails in accordance with a first predetermined pattern for the top deck of, for example, a pallet, and at the other position a second predetermined pattern of nails is fed for driving into the bottom deck. Any number of stringers may be attached using the one pattern for the top deck and the other pattern for the bottom deck.

2 Claims, 6 Drawing Figures

FEEDER FOR NAILING MACHINE

BACKGROUND OF THE INVENTION

1. Field of the Invention

This invention as classified in and by the U.S. Patent and Trademark Office is believed to be found in the general class titled, "Elongated-Member-Driving Apparatus" (Class 227) and in the subclass therein titled, "With means to move or guide member into driving condition-Adaptable to dispense different sizes of quantities of members" (subclass 109).

2. Description of the Prior Art

This application describes improvements for feeding any type of nail, drive screw, coated, common or box nail into a heavy duty nailing machine. This nailing machine is particularly useful in the nailing of pallets, boxes and the like. The basis nailing machine is described in U.S. Pat. No. 3,273,776 as issued to BRYSON on Sept. 20, 1966. Nailing machines before and since that date have been a staple of commerce particularly for pallets and the like. The heavy duty nailing machine of this invention includes a dual position drum bar which is actuated by a programming device to select nails for both a bottom and top deck of a pallet to be nailed together.

SUMMARY OF THE INVENTION

This invention may be summarized at least in part with reference to its object.

It is an object of this invention to provide, and it does provide, a nailing machine like that shown in U.S. Pat. No. 3,273,776, above identified, in which the programming means is provided for selecting the nail to be used for attaching top and bottom decks. This improved control enables any number of stringers to be nailed to a support with a selected length and number of nails.

The two position drum bar, to be hereinafter more fully described, has a programmed control that is adapted to actuate a pneumatic cylinder. This cylinder moves the nail feeder drum bar into position to deliver a selected nail in a predetermined pattern to a nailing head for attaching a stringer or stringers to provide a deck attachment. This improvement eliminates the need for as many as twelve turns of gearing to control the selection of nails to be used. In the two position drum bar there is only two rows of plugs requiring only two turns for establishing the pattern of nail drive. This arrangement requires the "set-up" attendant to more rapidly establish the desired pattern and time and maintenance is reduced. A timer is used to provide an automatic control for the accumulation of nails in the feeder. That is to say, the control circuit prevents excessive nail build-up in the feeder. The programmer also provides an automatic raising and lowering of the work table and back stop or gage. This same controller also automatically moves the table to an "up" or "down" position after a nailing sequence.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of improvements as adopted for use for a nailing machine and showing a preferred means for making a programmed change for a nail feeding and pattern. This specific embodiment has been chosen for the purposes of illustration and description as shown in the accompanying drawings wherein.

BRIEF DESCRIPTION OF THE DRAWINGS

In the following description and in the claims various details are identified by specific names for convenience. These names are intended to be generic in their application. Corresponding reference characters refer to like members throughout the six figures of the drawings.

The drawings accompanying, and forming part of, this specification disclosure details of construction for the purpose of explanation but structural details may be modified without departure from the concept and principles of the invention and the invention may be incorporated in other structural forms than shown.

DESCRIPTION OF THE PREFERRED EMBODIMENT

Figure 2:
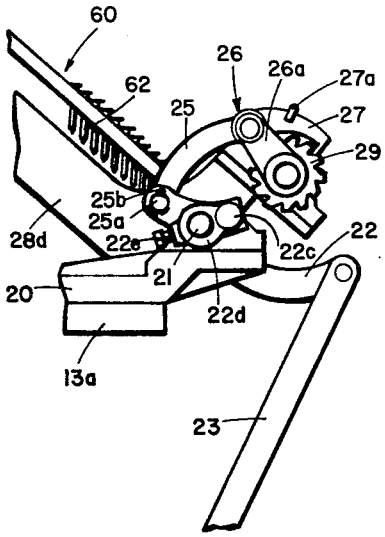
Fig. 2 Prior Art
FIG. 2 represents a fragmentary side view showing in enlarged detail the ratchet mechanism of FIG. 1, this view also labeled prior art.
Figure 1:
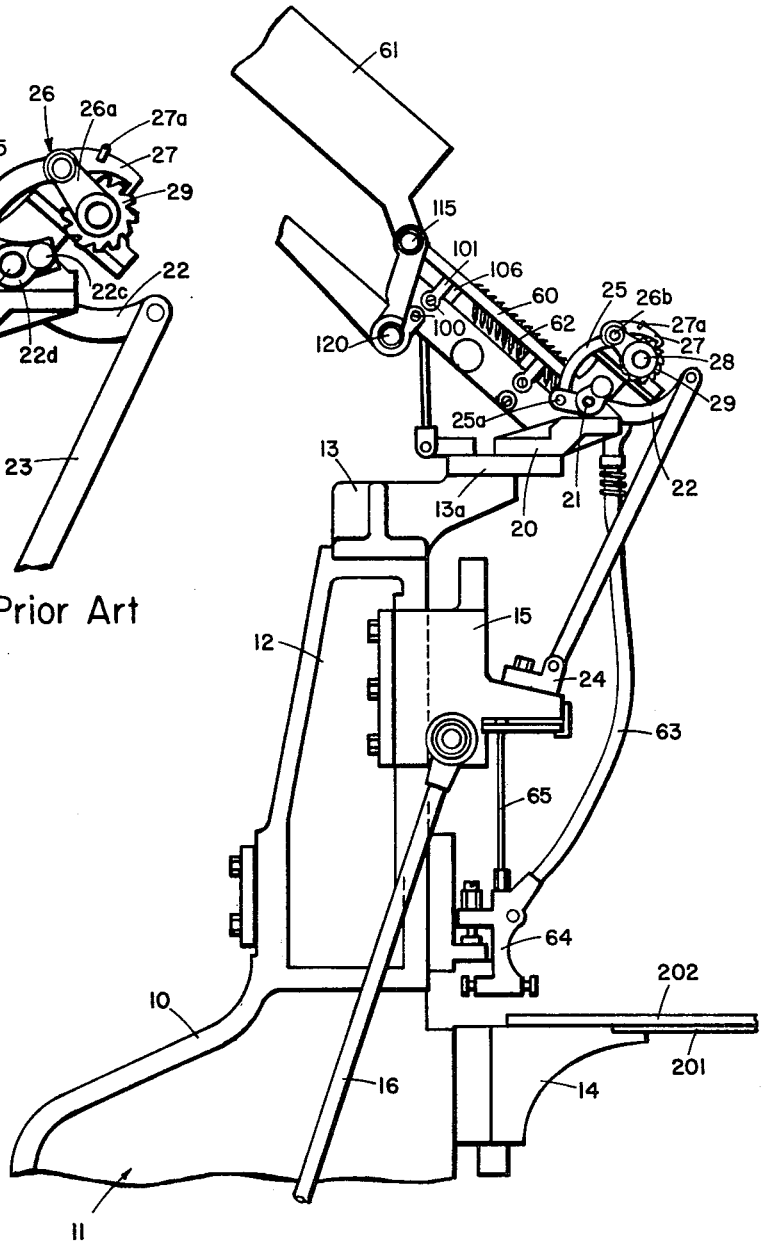
Fig. 1 Prior Art
FIG. 1 represents a side view, partly diagrammatic, and showing a side elevation of the upper portion of a nailing machine, this view being of the apparatus of U.S. Pat. No. 3,273,776 and labeled prior art.

Referring now to the drawings and in particular to FIGS. 1 and 2, it is noted that these showings have been labeled "Prior Art". These FIGS. represent the apparatus depicted in U.S. Pat. No. 3,273,776, above identified, and in particular FIGS. 2 and 3 therein. A description of this apparatus is found in Col. 2, lines 59 through 73; Col. 3, lines 1 through 65; Col. 4, lines 10 through 24 and claims. The description and function of the apparatus as to frame 10; vertical side members 11; extensions 12; traverse member 13; feeder bed 13 *a;* work support or table 14; cross-head, and pitman 15 is defined. Also shown are the feeder bed bracket 20; shaft 21; arm 22 *a;* recessed portion 22 *b;* locking pin 22 *c;* collar 22 *d;* link 23; lug 14; link 25; pivot pin 25 *a;* cotter pin 25 *b;* pawl 27; torsion spring 27 *a;* shaft 28; frame bracket 28 *d,* and the ten-toothed ratchet 29. In the prior art identified in FIGS. 1 and 2 are shown the nail chute 60; hopper 61; nails 62; nailfeed tubes 63; nail chucks 64 and plungers 65. Machine screws 100; traverse support bars 101; traverse bars 106; shafts 115 and a shaft 120 are also shown and described as well as traverse work table 201 and stop member 202.

DESCRIPTION OF THE APPARATUS OF FIG. 3

Figure 3:
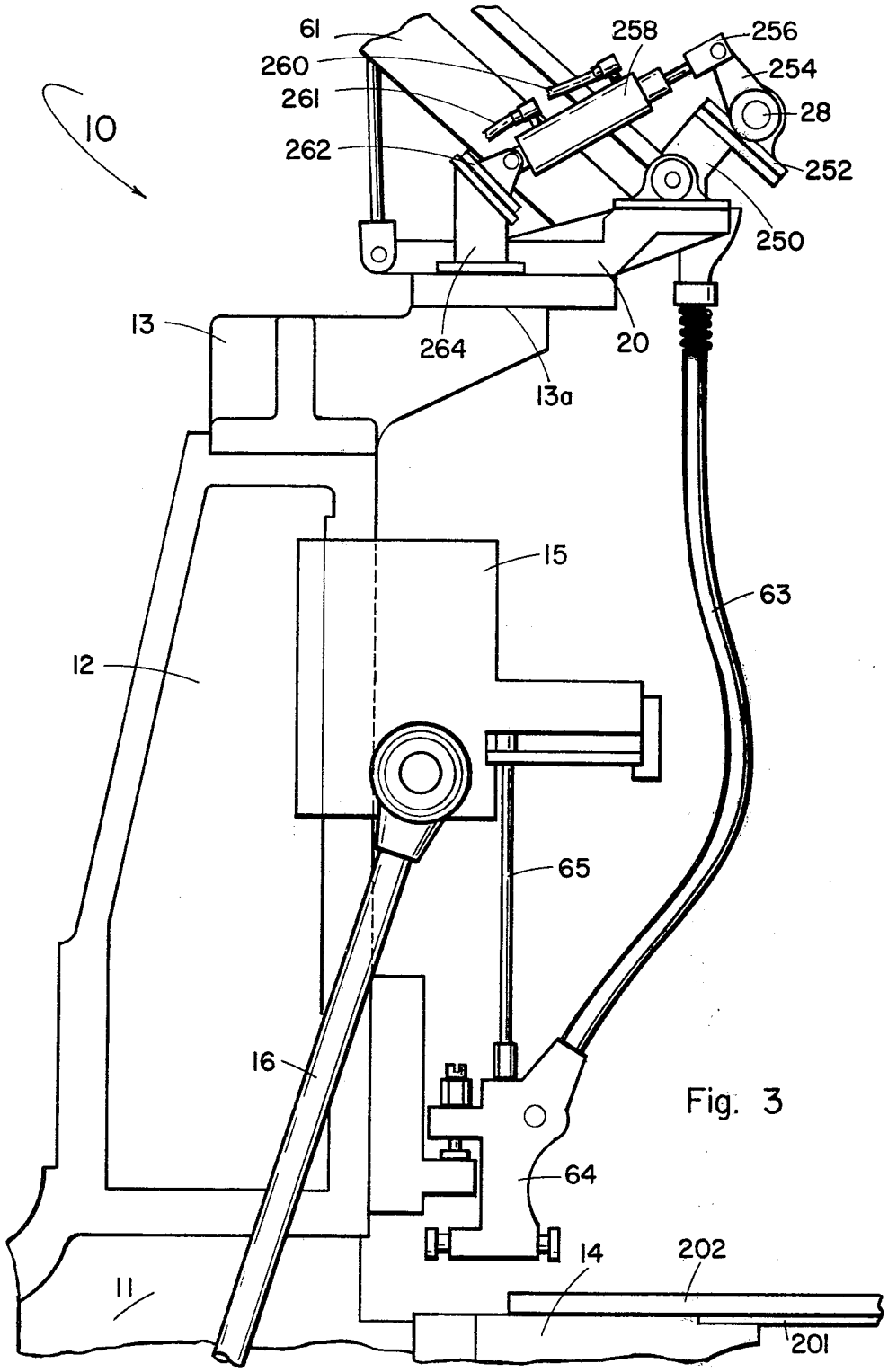
FIG. 3 represents a side view of the apparatus of FIG. 1 but with an improved two position bar which is actuated by a pneumatic cylinder in response to a predetermined program.

In FIG. 3 the nailing machine of FIGS. 1 and 2 is shown but with significant improvements. Frame 10 with vertical side members 11 and 12 has the transverse member 13 extending therebetween. The feeder bed 13 *a* is also carried on and by the transverse member 13 in the manner described in the referenced patent. The cross head 15 is cycled up and down by pitman arm 16 by a conventional mechanism. The stop 202 carried by the transverse work table 201 is cycled up and down with support table 14 by programmed means. Upper and lower stringers of a pallet are secured by nails, screws or like securing means. Nails 62 are delivered from hopper 61 to nail feed tubes 63 thence to drive chucks 64. The nails 62 are driven in the desired pattern by plungers 65. The prior art method of feeding nails 62 to tubes 63 as by a ten-toothed ratchet is now achieved by a two position drum-bar carried on shaft 28.

Above feeder bed bracket 20 and carried thereby is a support 250 which provides a mounting for a pillow block 252. This pillow block, as reduced to practice, is also used at the other end of shaft 28 and at an intermediate position and provides a bearing support for the rotational movement of said shaft 28. At the end of this shaft 28 and secured to it is a lever arm 254 which is seen in detail in FIG. 5. This lever arm is moved at its outer end by a pivotally connected clevis 256 moved by a pneumatic cylinder 258. This cylinder is positively moved to its two limits or extents by pressurized air moving through conductor 260 or 261. A clevis foot support or bracket 262 pivotally supports the foot or left end of the cylinder 258. A pedestal 264 carries this clevis bracket 262 and is disposed at a determined angle to define the proposed action. Bolts or cap screws, not shown, secure said pedestal 264 to the feeder bed 13 *a*.

Figure 5:
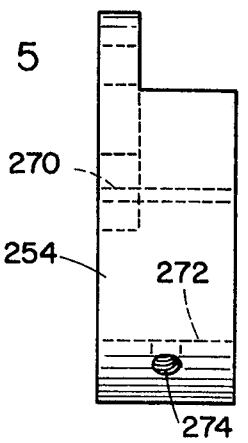
FIG. 5 represents an end view of the shaft arm used with the apparatus of FIG. 4.
Figure 6:
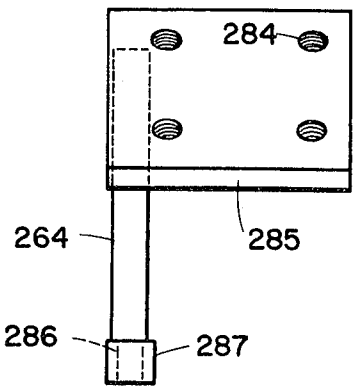
FIG. 6 represents an end view of the support bracket for the fixed lower end of the cylinder of FIG. 4.
Figure 4:
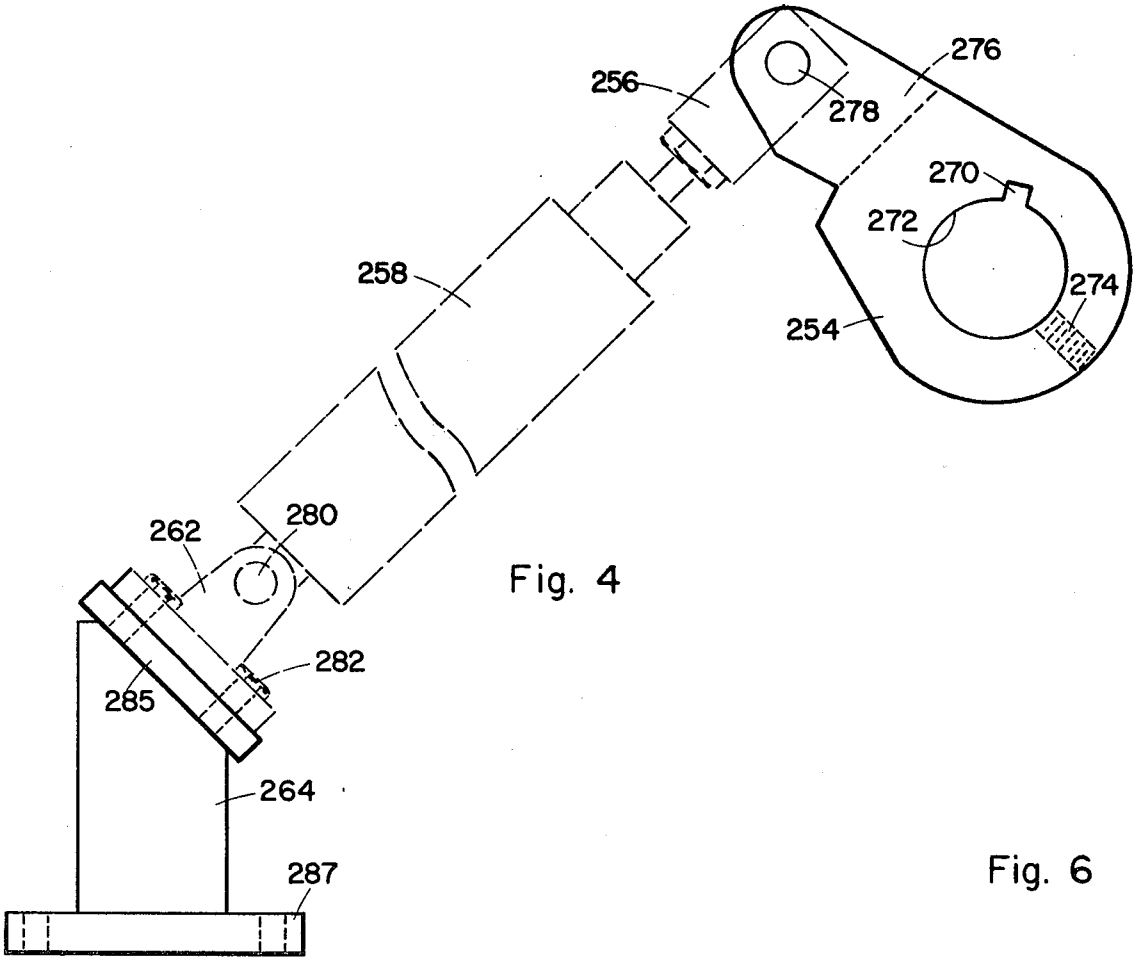
FIG. 4 represents a side view, partly diagrammatic, and showing in a greatly enlarged view the cylinder and the associated support components.

ACTUATING MECHANISM AS IN FIGS. 4, 5 and 6

There is shown in greater detail in FIGS. 4, 5 and 6 the several components that, as reduced to practice, are used to achieve the two position programmed control of FIG. 3. As depicted in FIGS. 4 and 5, the lever arm 254 is made from a single metal member and has a keyway 270 which mates with a like keyway formed in shaft 28. An appropriately provided key, not shown, insures that this shaft is rotated only a determined degree. A bore 272 is a snug fit on this shaft 28 and a set screw carried in a threaded hole 274 secures lever arm 254 in place on shaft 28. This arm is reduced in thickness at 276 and a hole 278 is provided to allow the pivotal motion by connected cylinder 258.

Clevis and support 262 of said cylinder 258 has a hole 280 for pivot pin carried therein. This support 262 is secured to pedestal 264 by means of cap screws 282 that enter and are retained in threaded holes 284. Pedestal 264 is secured to feeder bed 13*a* by screws positioned in holes 286 in mounting base 287.

Disposed along shaft 28 at the various nail feeding stations are cylindrical drum members (not shown), such as 30 of U.S. Pat. No. 3,273,776. Because of the improvement of the present invention, i.e. a two position drum bar, each of drums 30 now need only include two openings 31*a*. These are disposed again on the surface of the drum and are angularly set off from each other by a predetermined amount, for example 15°. The drums are fixedly secured to shaft 28 and are aligned so that one set of openings are utilized to effect the nail pattern of the top deck, while the second set control the nail configuration of the bottom deck. As before, plugs 31*b* would be inserted in those openings of each drum at the corresponding nail feeding station where no nail is to be picked and fed. The operation is identical to that described for the machine of the aforementioned patent as detailed at Col. 3, line 66 to Col. 4, line 36.

The control of the sequential operation of the machine is accomplished by a programming device (not shown) such as the Model 2420 stepping switch, manufactured by the Tenor Company of New Berlin, Wis. This device comprises a drum assembly made up of individual discs. The number of discs selected depends on the number of switches which are to be activated which in turn depends on the number of control functions to be implemented. Control of the sequential operations is accomplished by means of plugs inserted in the drum. The drum is stepped by a motor-driven Geneva drive so that the plugs actuate the switches which in turn accomplish the desired action, for example, raising and lowering the table; setting the stops for proper placement of the pallet; activating the appropriate nail feeding stations; driving the cylinder 258 to its two limits, etc.

The improved nailing machine of the present invention has been found to be much faster in operation than its predecessor described in U.S. Pat. No. 3,273,776. A typical sequence would be as follows: prior to initiating any nailing sequence, the operator inserts plugs 31*b* in the corresponding openings in the drums 30 as determined by the desired nail pattern for the top and bottom deck. The machine is energized and the programmer controls a switch which in turn provides electrical power to the table-drive motor. The table is lowered allowing the pallet stringers with top deck boards to be positioned on the work surface of table 201. Further, an initial set of stops for assisting in positioning the first stringer under the plungers 65 are activated by the programmer. The programmer typically then calls for raising the table to a level just below the plungers and, thereafter, directs activation of the latter to effect the nailing of the deck boards to the stringer. Thereafter, the programmer directs lowering of the initial set of stops, and the raising of a second set at a point on the work table which results in the alignment of the second stringer under the plungers. The deck boards are then nailed to this second stringer. This procedure is continued until the top deck surface is complete. The programmer next directs the lowering of the work table to enable the pallet to be removed and turned over. It further activates the air cylinder through the corresponding switch and a suitable electrical to pneumatic converter device, moving it to the other limit, and, consequently, rotating shaft 28 and drums 30 to the second position. The table is raised to the work position, the initial set of stops raised, and the nailing operation for the bottom deck effected in accordance with the desired pattern. At the completion of the nailing, the table is lowered and the finished pallet is removed. The programmer at this point has completed its cycle ready to initiate a second.

The present invention with only two rows of plugs as compared to the ten or twelve of the previous device makes setting up easier, requiring less maintenance. By suitable programming of the stepper switch any number of stringers can be nailed to the deck boards using the first position of the drum bar for the top deck and the second position for the bottom deck.

While a particular embodiment of the nail feed control has been shown and described it is to be understood the invention is not limited thereto since modifications may be made within the scope of the accompanying claims and protection is sought to the broadest extent the prior art allows.

What is claimed is:

1. In a nailing machine having a plurality of nail feeding means, means for controlling the discharge of nails from the nail feeding means, feed governing means associated with the controlling means at each of the nail feeding means, a work table for supporting a work piece to be nailed, means for driving nails advanced by the nail feed controlling means into the work piece supported on the work table, wherein the improvement comprises the nail discharge control means and the feed governing means including:

(a) a feed control drum bar rotatably mounted on the nail machine;

(b) programmer means for generating a plurality of control signals for sequencing the nail machine through various work steps comprising a complete work cycle;

(c) means for rotating said feed control drum bar back and forth between a first and second position only in response to predetermined ones of said control signals; and, (d) means fixedly disposed on said feed control bar for controlling the dispensing of nails from the nail feeding means at each of said first and second positions in accordance with first and second predetermined patterns.

2. The improved nailing machine claimed in claim 1 wherein said means for rotating said feed control bar includes a pneumatic cylinder device axially displaceable back and forth between a third and fourth position corresponding to said first and second position of said feed control drum bar.

* * * * *